US005992653A

United States Patent [19]

Anderson et al.

[11] Patent Number: 5,992,653

[45] Date of Patent: Nov. 30, 1999

[54] DISPLAY AND DISPENSING PACK

[75] Inventors: Robert H. Anderson, Blue Bell, Pa.; Stanley J. Jurgenburg, Los Angeles, Calif.; David C. Rolston; Mark E. Gilpatric, both of Milwaukee, Wis.

[73] Assignee: J & J Snack Foods Corp., Pennsauken, N.J.

[21] Appl. No.: 08/993,438

[22] Filed: Dec. 18, 1997

[51] Int. Cl.[6] ..... A47F 1/04

[52] U.S. Cl. ..... 211/59.3

[58] Field of Search ..... 211/59.3, 51, 59.2, 211/52, 128.1

[56] References Cited

U.S. PATENT DOCUMENTS

| | | | |
|---|---|---|---|
| D. 255,407 | 6/1980 | Brittner | D6/172 |
| D. 352,850 | 11/1994 | Fujii | D6/479 |
| 1,702,987 | 2/1929 | Wilson | 211/59.3 |
| 3,279,618 | 10/1966 | Bergstedt | 211/49 |
| 4,706,821 | 11/1987 | Kohls et al. | 211/593 |
| 4,762,235 | 8/1988 | Howard et al. | 211/59.3 |
| 5,351,839 | 10/1994 | Beeler et al. | 211/59.3 |
| 5,464,279 | 11/1995 | Wells et al. | 312/128 |
| 5,855,281 | 1/1999 | Rabas | 211/59.3 |

*Primary Examiner*—Alvin Chin-Shue
*Assistant Examiner*—Sarah Purol
*Attorney, Agent, or Firm*—Quarles & Brady LLP

[57] ABSTRACT

A display and dispensing rack comprises: a base and at least one shelf, each having a top surface and each attached to a left and a right side frame; at least one inclined slide defined by the top surface and inclined upwardly from a front edge to a rear edge; a front article stop adjacent to the front edge limiting forward sliding of the articles; a pushplate; at least one guide rail for the pushplate defining a path between the rear edge and the front stop; and, the pushplate having a front face inclined at a generally upright orientation as the pushplate urges the articles along the path toward the front article stop.

18 Claims, 2 Drawing Sheets

DISPLAY AND DISPENSING PACK

BACKGROUND OF THE INVENTION

1. Field of the Invention

This invention relates to display and dispensing racks for use in restaurants, cafeterias, convenience stores, airports, ballparks, shopping malls, road-side stands, or other locations where merchandise is displayed and dispensed. More particularly, this invention relates to a new and improved method of delivering to the front of a rack and displaying stable and even unstable articles in an upright fashion.

2. Description of Related Art

In the past, several racks have been developed that display and deliver articles to the front of a rack. One example, as shown in U.S. Pat. No. 3,279,618, is a bottle dispenser with parallel shelves having sloping surfaces. The surfaces downwardly slope from back to front so when an articles is placed on a shelf, the article tends to slide to the front of the bottle dispenser. The articles, when stationary on the rack, tend to tip towards the front of the rack.

Another example, as shown in U.S. Pat. No. 4,706,821, is a merchandise display and dispensing device with parallel shelves having sloping surfaces. The surfaces upwardly slope from back to front so when an article is placed on a shelf, the article tends to slide towards the rear of the rack. The rack has a spring biased pushplate to push the articles to the front of the rack. The articles, when stationary on the rack, rest on the pushplate and tend to tip towards the rear of the rack.

U.S. Pat. No. 5,464,279 is an example that of a hot countertop self-service food station with parallel shelves having sets of sloping rails. The rails downwardly slope from back to front so when an articles is placed on a set of rails, the article tends to slide to the front of the food station. The articles, when stationary on the rack, tend to tip towards the front of the rack.

The racks described above do not provide a dispensing device that fully displays the articles, that uses gravity as the force that urges the articles towards the front of the rack, and that can be used with articles that must be displayed at a particular orientation. The racks that have shelves that slope down from back to front which tip the articles forward cannot be used with tall articles having small bases such as soft pretzels, french fry containers, or candy bars standing on end. If these articles were tipped forward, the articles would fall out of the rack. Additionally, these articles cannot be laid on their side because such an orientation would inefficiently store the articles or such an orientation could cause leakage or breakage or the articles.

SUMMARY OF THE INVENTION

In accordance with the invention, these and other problems with the prior art are avoided by providing a display and dispensing rack which provides an improved delivery to the front of a display and dispensing rack for stable and even unstable articles in an upright fashion.

A display and dispensing rack in accordance with an inventive arrangement comprises: a base and at least one shelf, each having a top surface and each attached to a left and a right side frame; at least one inclined slide defined by the top surface and inclined upwardly from a front edge to a rear edge; a front article stop adjacent to the front edge limiting forward sliding of the articles; a pushplate; at least one guide rail for the pushplate defining a path between the rear edge and the front stop; and, the pushplate having a front face inclined at a generally upright orientation as the pushplate urges the articles along the path toward the front article stop.

The guide rail is defined by a pair of opposing side rails parallel to the slide and extending from the front article stop to a rear pushplate stop, the rear pushplate stop adjacent to the rear edge. The pushplate is positioned between the pair of side rails. Also, the top surface can define a pair of side-by-side slides.

A display and dispensing rack in accordance with another inventive arrangement comprises: a base supporting left and right side frames, the side frames supporting at least one shelf having a top surface; at least one inclined slide defined by the top surface and inclined upwardly from a front edge to a rear edge; a front article stop adjacent to the front edge limiting forward sliding of the articles; a pushplate; at least one guide rail for the pushplate defining a path between the rear edge and the front stop; and, the pushplate having a front face inclined at a generally upright orientation as the pushplate urges the articles along the path toward the front article stop.

As in the first inventive arrangement, the guide rail is defined by a pair of opposing side rails parallel to the slide and extending from the front article stop to a rear pushplate stop, the rear pushplate stop adjacent to the rear edge. The pushplate is positioned between the pair of side rails. Also, the top surface can define a pair of side-by-side slides.

A display and dispensing rack in accordance with still another inventive arrangement comprises: a base having a top surface; at least one inclined slide defined by the top surface and inclined upwardly from a front edge to a rear edge; a front article stop adjacent to the front edge limiting forward sliding of the articles; a pushplate; at least one guide rail for the pushplate defining a path between the rear edge and the front stop; and, the pushplate having a front face inclined at a generally upright orientation as the pushplate urges the articles along the path toward the front article stop.

As in the first and second inventive arrangements, the guide rail is defined by a pair of opposing side rails parallel to the slide and extending from the front article stop to a rear pushplate stop, the rear pushplate stop adjacent to the rear edge. The pushplate is positioned between the pair of side rails. Also, the top surface can define a pair of side-by-side slides.

BRIEF DESCRIPTION OF THE DRAWING

Presently preferred embodiments of the inventive arrangements are shown in the drawings, it being understood, however, the inventive arrangements are not limited to the precise arrangements and instrumentalities shown.

DETAILED DESCRIPTION OF THE PREFERRED EMBODIMENT

Figure 1:
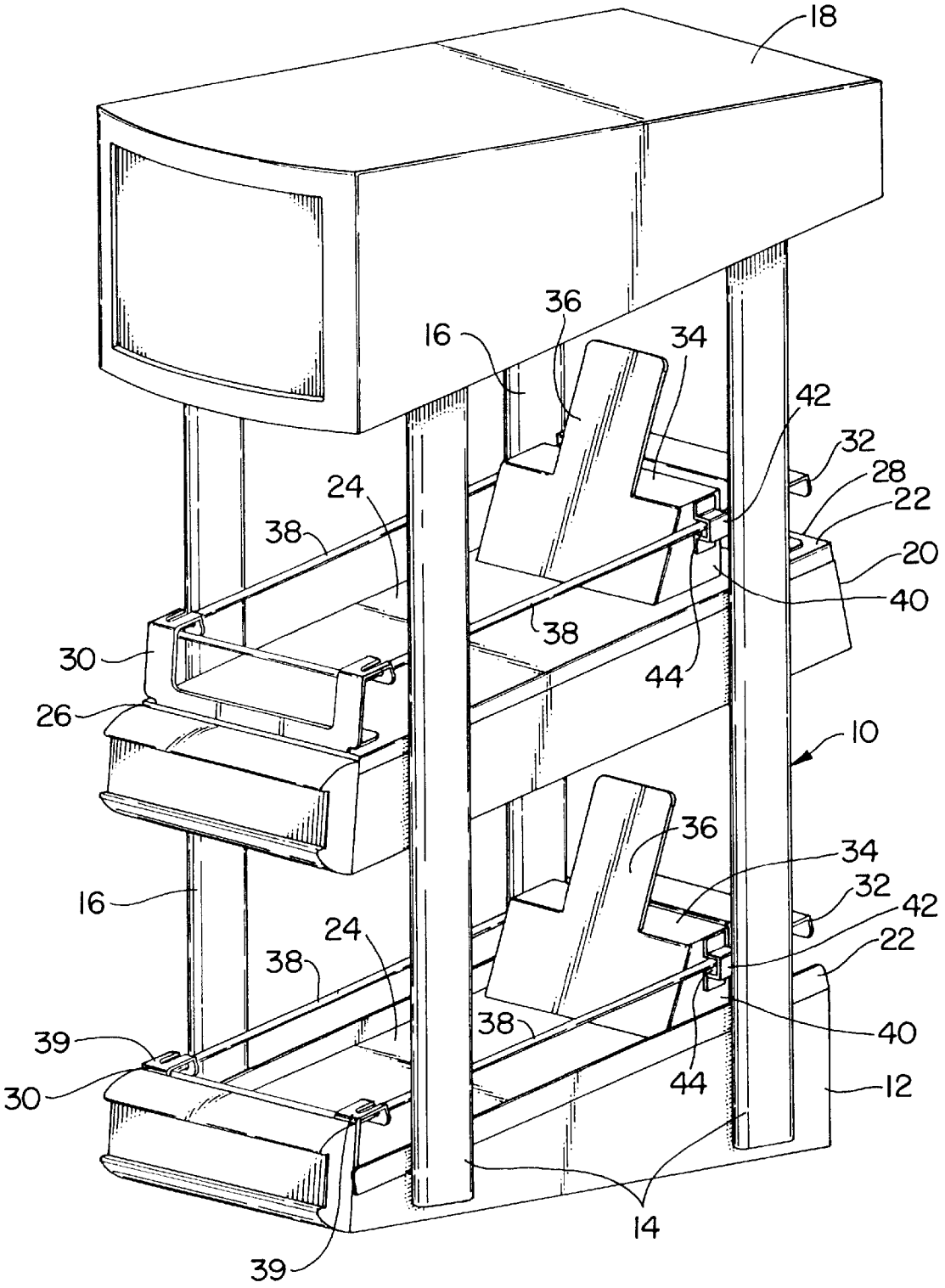
FIG. 1 is a right front top perspective of a display and dispensing rack.

FIG. 1 illustrates the display and dispensing rack according to an inventive arrangement. The display rack 10 comprises a base 12, a right side frame 14, a left side frame 16, a top cover 18, and a shelf 20. The right side frame 14 and the left side frame 16 are attached to the base 10 and support the shelf 20 and the top cover 18. The vertical distance between the bottom surface 19 of the top cover 18 and the top surface 22 of the shelf 20 and the vertical distance between the bottom surface 19 of the shelf 20 and the top surface 22 of the base 12 should be greater than the height of an article 50, shown in FIG. 2.

The top surfaces 22 of the shelf 20 and the base 12 each define an inclined slide 24. The inclined slide 24 inclines upwardly from a front edge 26 to a rear edge 28. A front article stop 30 is adjacent to the front edge 26 to keep the articles 50 from falling off the inclined slide 24. The distance vertically upward from the top of the front article stop 30 to the bottom surface 19 should be sufficient to allow easy removal of an article 50 from the inclined slide 24. A rear pushplate stop 32 is adjacent to the rear edge 28.

Opposing side rails 38 are parallel to the inclined slide 24 and are attached to the front article stop 30 and the rear pushplate stop 32. The side rails 38 are attached to the front article stop 30 and the rear pushplate stop 32 by snap fitting the side rails 38 into slots 39 in the front article stop 30 and the rear pushplate stop 32. The side rails 38 define a path on the inclined slide 24 along which the pushplate 34 slides. The distance between the opposing side rails 38 should be greater than the width of an article 50.

Figure 2:
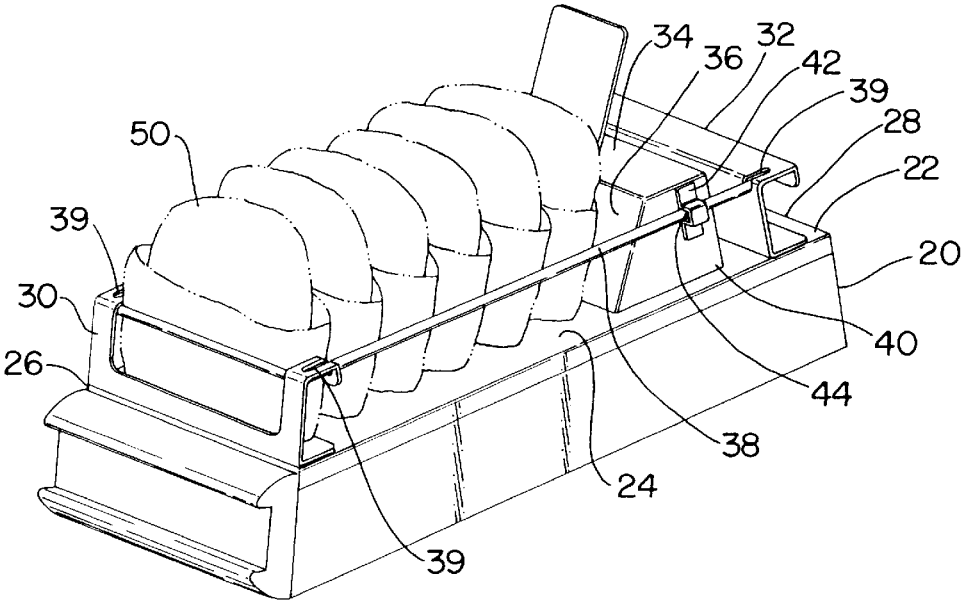
FIG. 2 is a right front top perspective of a single width tray.

FIG. 2 illustrates the positioning of the articles 50 on the inclined slide 24. The articles 50, such as pretzels, french fries, or candy bars, rest upon the front face 36 of the pushplate 34. The angle of the front face 36 with respect to ground should be less than 90 degrees to backwardly tip the articles 50 in a stable position. The height of the front face 36 should be greater than the height of the center of gravity of the article 50 to prevent the article 50 from tipping over the front face 36.

The angle of the front face 36 with respect to the inclined slide 24 should be less than 90 degrees minus the angle of the inclined slide 24 with respect to ground. The angle of the inclined slide 24 with respect to ground should be sufficient enough to have the pushplate 34 slide towards the front article stop 30, but the angle of the inclined slide 24 with respect to ground should not be so great as to have the pushplate 34 damage or crush the articles 50 or make removal of the articles 50 from the inclined slide 24 excessively difficult.

When an article 50 is removed from the inclined slide 24, the pushplate 34 urges the remaining articles 50 down the inclined slide 24. This urging of the pushplate 34 against the remaining articles 50 keeps the orientation of and the distance between the remaining articles 50 constant.

Each pushplate 34 has a pair of opposing side surfaces 40 on which a U-shaped guide-clip 42 is attached to each side surface 40. The combination of the U-shaped guide-clip 42 to the side surface 40 define a channel 44 that has a centerline parallel to the side rail 38. The width of the channel 44 is greater than the width of the side rail 38, and the channel 44 is positioned on the side surface 40 to allow the side rail 38 to slide through the channel 44.

Figure 3:
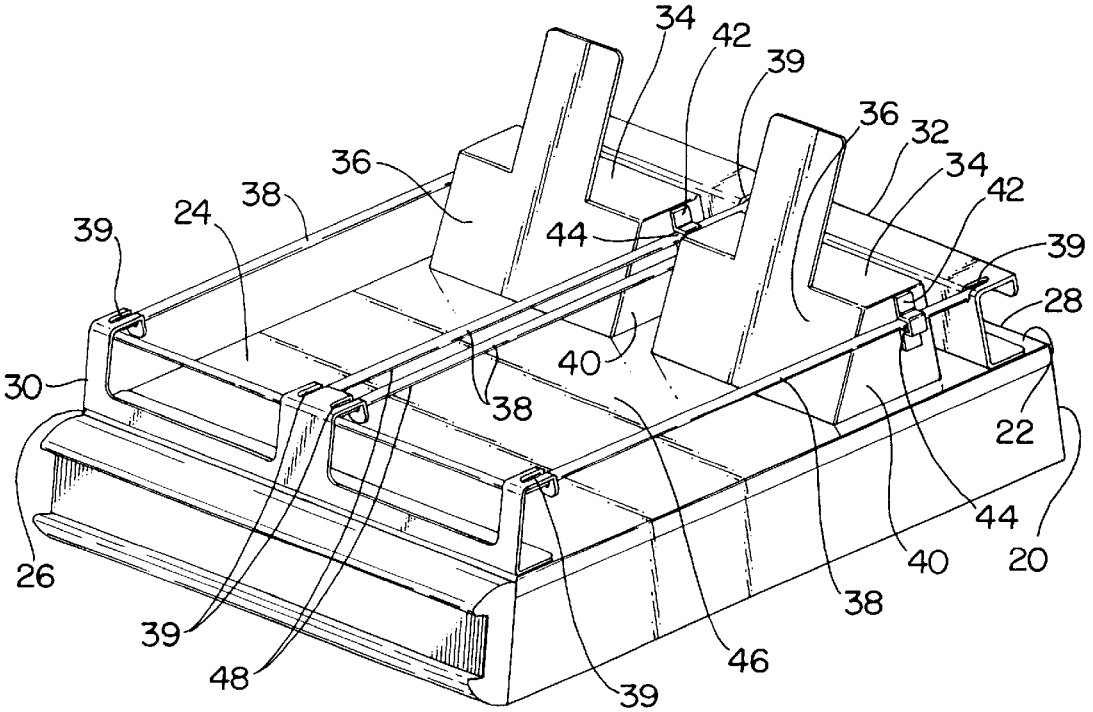
FIG. 3 is a right front top perspective of a double width tray.

FIG. 3. illustrates an alternative embodiment of a top surface 22. The top surface 22 defines an inclined slide 24 and a second inclined slide 46 that are side-by-side. Both of the slides 24 and 46 have equivalent dimensions so the features related to these slides 24 and 46 such as the pushplate 34, side rails 38, the front article stop 30, and the rear pushplate stop 32 are interchangeable between slides 24 and 46.

What is claimed is:

1. A display rack for use in dispensing articles, said display rack comprising:

a base and at least one shelf, each having a top surface and each attached to a left and a right side frame;

at least one inclined slide defined by said top surface and inclined upwardly from a front edge to a rear edge;

a front article stop adjacent to said front edge limiting forward sliding of the articles;

a pushplate;

at least one guide rail for said pushplate defining a path between said rear edge and said front stop; and, a front face of said pushplate, said front face inclined at an angle to backwardly tip the articles towards said rear edge as said pushplate urges said articles along said path toward said front article stop.

2. A display rack according to claim 1, further comprising a top cover attached to said side frames.

3. A display rack according to claim 1, wherein said guide rail is defined by a pair of opposing side rails parallel to said slide and extending from said front article stop to a rear pushplate stop, said rear pushplate stop adjacent to said rear edge.

4. A display rack according to claim 3, wherein said pushplate is positioned between said pair of side rails, said pushplate having a pair of side surfaces adjacent and to said side rails.

5. A display rack according to claim 4, further comprising a U-shaped guide-clip attached at both ends of said guide-clip to said side surface to define a channel, said guide-clip positioned relative to said side rail to permit said side rail to pass through said channel.

6. A display rack according to claim 1, wherein said top surface defines a pair of side-by-side slides.

7. A display rack for use in dispensing articles, said display rack comprising:

a base supporting left and right side frames, said side frames supporting at least one shelf having a top surface;

at least one inclined slide defined by said top surface and inclined upwardly at an angle from a front edge to a rear edge;

a front article stop adjacent to said front edge limiting forward sliding of said articles;

a pushplate disposed on the inclined slide, said inclined slide sufficiently angled whereby gravity urges said pushplate towards said front edge;

at least one guide rail for said pushplate defining a path between said rear edge and said front stop; and, a front face of said pushplate, said front face inclined at a generally upright orientation.

8. A display rack according to claim 7, further comprising a top cover attached to said side frames.

9. A display rack according to claim 7, wherein said guide rail is defined by a pair of opposing side rails parallel to said slide and extending from said front article stop to a rear pushplate stop, said rear pushplate stop adjacent to said rear edge.

10. A display rack according to claim 9, wherein said pushplate is positioned between said pair of side rails, said pushplate having a pair of side surfaces adjacent and to said side rails.

11. A display rack according to claim 10, further comprising a U-shaped guide-clip attached at both ends of said guide-clip to said side surface to define a channel, said guide-clip positioned relative to said side rail to permit said side rail to pass through said channel.

12. A display rack according to claim 7, wherein said top surface defines a pair of slides.

13. A display rack for use in dispensing articles, said display rack comprising:

a base having a top surface;

at least one inclined slide defined by said top surface and inclined upwardly from a front edge to a rear edge;

a front article stop adjacent to said front edge limiting forward sliding of said articles;

a pushplate;

at least one guide rail for said pushplate defining a path between said rear edge and said front stop; and, a front face of said pushplate, said front face inclined at an angle to backwardly tip the articles towards said rear edge as said pushplate urges said articles along said path toward said front article stop.

14. A display rack according to claim 17, further comprising a left and a right side frame attached to said base, said side frames supporting a top cover.

15. A display rack according to claim 13, wherein said guide rail is defined by a pair of opposing side rails parallel to said slide and extending from said front article stop to a rear pushplate stop, said rear pushplate stop adjacent to said rear edge.

16. A display rack according to claim 15, wherein said pushplate is positioned between said pair of side rails, said pushplate having a pair of side surfaces adjacent and to said side rails.

17. A display rack according to claim 16, further comprising a U-shaped guide-clip attached at both ends of said guide-clip to said side surface to define a channel, said guide-clip positioned relative to said side rail to permit said side rail to pass through said channel.

18. A display rack according to claim 13, wherein said top surface defines a pair of side-by-side slides.

* * * * *

UNITED STATES PATENT AND TRADEMARK OFFICE

CERTIFICATE OF CORRECTION

PATENT NO. : 5,992,653

DATED : November 30, 1999

INVENTOR(S) : Anderson et al.

It is certified that error appears in the above-indentified patent and that said Letters Patent is hereby corrected as shown below:

Item [54], title of the invention: "DISPLAY AND DISPENSING PACK" should read --DISPLAY AND DISPENSING RACK--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*